US012434352B2

(12) United States Patent
Qu

(10) Patent No.: US 12,434,352 B2
(45) Date of Patent: Oct. 7, 2025

(54) KNIFE SHARPENER AND KNIFE SHARPENING DEVICE

(71) Applicant: Shiji Qu, Liaoning (CN)

(72) Inventor: Shiji Qu, Liaoning (CN)

( * ) Notice: Subject to any disclaimer, the term of this patent is extended or adjusted under 35 U.S.C. 154(b) by 223 days.

(21) Appl. No.: 18/446,531

(22) Filed: Aug. 9, 2023

(65) Prior Publication Data

US 2025/0050471 A1 Feb. 13, 2025

(51) Int. Cl.
*B24D 15/08* (2006.01)

(52) U.S. Cl.
CPC ..... *B24D 15/082* (2013.01)

(58) Field of Classification Search
CPC ..... B24D 15/082; B24D 15/085
See application file for complete search history.

(56) References Cited

U.S. PATENT DOCUMENTS 1,360,998 A * 12/1920 Barber ..... B24D 15/082 451/545
1,417,158 A * 5/1922 Frankland ..... B24D 15/082 451/555
1,458,938 A * 6/1923 Heyman ..... B24D 15/082 76/89.2
2,646,653 A * 7/1953 Murchison ..... B24D 15/082 451/551
2,795,975 A * 6/1957 Stoner ..... B24D 15/082 76/89.2
3,163,965 A * 1/1965 Wheeler ..... B24D 15/061 451/555
3,390,489 A * 7/1968 Magrini ..... B24D 15/085 451/321
5,029,417 A * 7/1991 Keller ..... B24D 15/082 76/85
6,039,642 A * 3/2000 Collins ..... B24D 15/06 76/86
10,850,361 B1 * 12/2020 Dovel ..... B24D 15/081
2009/0275272 A1 * 11/2009 Bonapace ..... B24D 15/082 51/293
2013/0065494 A1 * 3/2013 Wu ..... B24D 15/082 451/344
2016/0207171 A1 * 7/2016 Weiner ..... B24D 15/082
2017/0036316 A1 * 2/2017 Giurlani ..... B24B 3/46
2017/0320185 A1 * 11/2017 Sandefur ..... B24B 3/543
2020/0376629 A1 * 12/2020 Baker ..... B24D 15/088
2021/0053171 A1 * 2/2021 Eklund ..... B24B 3/54

* cited by examiner

*Primary Examiner* — Omar Flores Sanchez

(57) ABSTRACT

The present disclosure provides a knife sharpener. The knife sharpener includes a hand shank and a sharpening member. Mounting portions are arranged at two ends of the hand shank. An outer diameter of each of the mounting portions is greater than an outer diameter of the hand shank. The sharpening member is connected to the mounting portions, so that the sharpening member and the hand shank rotate axially. During use, the knife sharpener is put on an operating platform, such as the ground or a tabletop, and the knife is fixed on one side of the knife sharpener. The knife can tilt towards an end portion of the knife sharpener to make a cutting edge lean against the sharpening member. During sharpening, a user pushes the hand shank back and forth with the palm, so that the knife sharpener moves back and forth relative to the knife.

15 Claims, 5 Drawing Sheets

KNIFE SHARPENER AND KNIFE SHARPENING DEVICE

TECHNICAL FIELD

The present disclosure relates to the technical field of knife sharpening, and in particular to a knife sharpener and a knife sharpening device.

BACKGROUND OF THE INVENTION

A knife stone is a tool for sharpening a knife. To sharpen a knife with an existing knife stone, the knife stone is usually fixed on an operating platform. Afterwards, a user holds the knife while a cutting edge of the knife leans against the knife stone, and applies the knife with an acting force that faces the knife stone. The user moves the knife to cause the knife to do reciprocating motion relative to the knife stone, so as to sharpen the knife.

For the above sharpening step, when the knife needs to be sharpened, the user first holds the knife to overcome the gravity of the knife itself. The acting force that faces the knife stone then needs to be applied to the knife. A friction between the knife and the knife stone also needs to be overcome, so that the knife performs a completion motion relative to the knife stone. As a result, the user needs to provide greater strength when sharpening the knife, which reduces the knife sharpening efficiency and is time-consuming and laborious.

SUMMARY OF THE INVENTION

The present disclosure aims to solve the technical problems in the background section that an existing knife stone has "low knife sharpening efficiency and is time-consuming and laborious".

The present disclosure provides a knife sharpener, which includes a hand shank and a sharpening member, wherein mounting portions are arranged at two ends of the hand shank; an outer diameter of each of the mounting portions is greater than an outer diameter of the hand shank; and the sharpening member is connected to the mounting portions, so that the sharpening member and the hand shank rotate axially.

Further, the sharpening member includes a first end portion and a second end portion; the first end portion is provided with a sharpening portion configured to sharpen a knife; and the second end portion is connected to the mounting portion.

Further, the mounting portion includes a first connecting mechanism; the second end portion includes a second connecting mechanism; the first connecting mechanism is detachably connected to the second connecting mechanism to detachably connect the sharpening member to the mounting portion.

Further, the first connecting mechanism includes a mounting opening arranged on an outer side of the mounting portion; the second connecting mechanism includes a connecting portion protruding from the second end portion; and each of the mounting opening and the connecting portion is provided with a threaded mechanism to achieve threaded connection between the connecting portion and the mounting opening.

Further, the first connecting mechanism includes a plugging opening arranged on an outer side of the mounting portion; the second connecting mechanism includes a plugging portion protruding from the second end portion; and the plugging portion is in plugged connection to the plugging opening.

Further, a first limiting portion is arranged in the plugging opening; the plugging portion is provided with a second limiting portion; and when the plugging portion is in plugged connection to the plugging opening, the first limiting portion resists against the second limiting portion to prevent the sharpening member from rotating relative to the hand shank.

Further, the sharpening piece includes a first sharpening unit and a second sharpening unit; the first sharpening unit is arranged on the mounting portion at one end of the hand shank; and the second sharpening unit is arranged on the mounting portion at the other end of the hand shank.

Further, the knife further including antiskid members, wherein the antiskid members surround the mounting portions.

The present disclosure also provides a knife sharpening device, including a base and a knife sharpener, wherein mounting portions are arranged at two ends of the hand shank; an outer diameter of each of the mounting portions is greater than an outer diameter of the hand shank; and the sharpening member is connected to the mounting portions, so that the sharpening member and the hand shank rotate axially, a supporting wall for allowing a knife to lean against is arranged on a side wall of the base; the supporting wall and the ground form a supporting angle; and the supporting angle is an acute angle.

Further, a fixing mechanism is arranged on the supporting wall and is configured to fix the knife on the supporting wall.

Further, the sharpening member includes a first end portion and a second end portion; the first end portion is provided with a sharpening portion configured to sharpen a knife; and the second end portion is connected to the mounting portion.

Further, the mounting portion includes a first connecting mechanism; the second end portion includes a second connecting mechanism; the first connecting mechanism is detachably connected to the second connecting mechanism to detachably connect the sharpening member to the mounting portion.

Further, the first connecting mechanism includes a mounting opening arranged on an outer side of the mounting portion; the second connecting mechanism includes a connecting portion protruding from the second end portion; and each of the mounting opening and the connecting portion is provided with a threaded mechanism to achieve threaded connection between the connecting portion and the mounting opening.

Further, the first connecting mechanism includes a plugging opening arranged on an outer side of the mounting portion; the second connecting mechanism includes a plugging portion protruding from the second end portion; and the plugging portion is in plugged connection to the plugging opening.

Further, a first limiting portion is arranged in the plugging opening; the plugging portion is provided with a second limiting portion; and when the plugging portion is in plugged connection to the plugging opening, the first limiting portion resists against the second limiting portion to prevent the sharpening member from rotating relative to the hand shank.

Further, the sharpening piece includes a first sharpening unit and a second sharpening unit; the first sharpening unit is arranged on the mounting portion at one end of the hand shank; and the second sharpening unit is arranged on the mounting portion at the other end of the hand shank.

Further, the knife further including antiskid members, wherein the antiskid members surround the mounting portions.

Compared with the prior art, the present disclosure has the beneficial effects below: it can be understood that the sharpening member is configured to sharpen a knife. Specifically, during use, the knife sharpener is put on an operating platform, such as the ground or a tabletop, and the knife is fixed on one side of the knife sharpener. The knife can tilt towards an end portion of the knife sharpener to make a cutting edge lean against the sharpening member. During sharpening, a user pushes the hand shank back and forth with the palm, so that the knife sharpener moves back and forth relative to the knife. In this process, the sharpening member always presses against the cutting edge and does reciprocating motion relative to the cutting edge, so as to sharpen the knife, which improves the knife sharpening efficiency, achieves convenient operations, saves time and labor, and solves the technical problem: "In the traditional knife sharpening manner, a user needs to hold the knife while the cutting edge of the knife leans against the knife stone, and the knife is caused to do reciprocating motion relative to the knife stone, which is time-consuming and laborious".

Further, in this embodiment, when the user pushes the hand shank to rotate, the mounting portions rotates coaxially with the hand shank, that is, angular velocities of the mounting portions and an angular velocity of the hand shank are always consistent. Based on the above principle, the present disclosure is creatively sets an outer diameter size of each mounting portion to be much greater than an outer diameter size of the hand shank because the small-sized hand shank is convenient to hold and push by the user and the large-sized mounting portion is in contact with the operating platform to drive the sharpening member to roll on the operating platform. By the above structural arrangement, when the user pushes the hand shank to rotate with the palm, the outer diameter size of each mounting portion is set to be much greater than the outer diameter size of the hand shank, so that the mounting portion can move for a longer distance than the hand shank under the same rotation angle, which expands a motion range of the knife sharpener on the operating platform. A larger motion range ensures, under the same rotation angle, that the sharpening member can sharpen the knife for longer time, which improves the sharpening efficiency of the knife sharpener and labor, has a simple structure, and is cleverly designed.

DETAILED DESCRIPTION OF THE INVENTION

Figure 1:
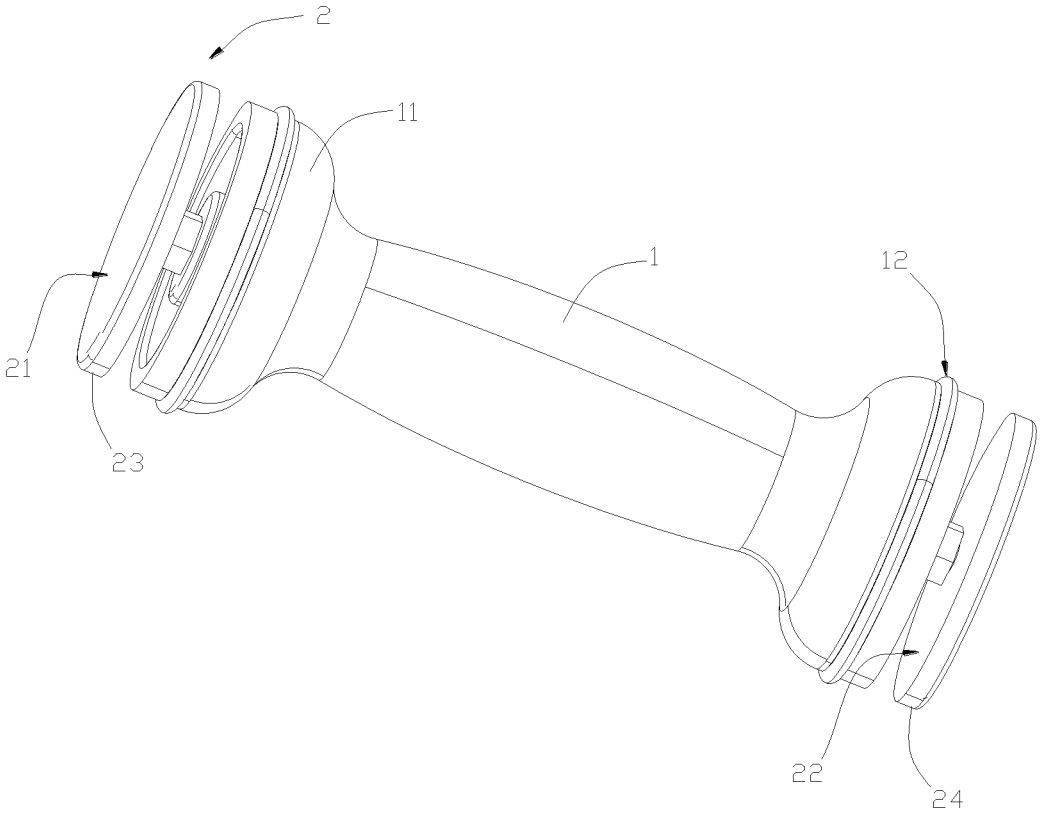
FIG. 1 is a schematic diagram of a three-dimensional state of a knife sharpener according to the present disclosure.

It is to be noted that embodiments in the present disclosure and features in the embodiments may be combined with each other without conflict.

In the description of the present disclosure, It is to be understood that, The terms "center", "longitudinal", "transverse", "upper", "lower", "front", "rear", "left", "right", "vertical", "horizontal", "top", "bottom", "inner", "outer", "clockwise", "counterclockwise", and the like indicate azimuth or positional relationships based on the azimuth or positional relationships shown in the drawings, For purposes of convenience only of describing the present disclosure and simplifying the description, Rather than indicating or implying that the indicated device or element must have a particular orientation, be constructed and operated in a particular orientation, therefore, not to be construed as limiting the present disclosure; in addition, The terms "first" and "second" are used for descriptive purposes only, While not to be construed as indicating or implying relative importance or implicitly specifying the number of technical features indicated thereby, features defining "first," "second," and "second" may explicitly or implicitly include one or more of the described features. In the description of the present disclosure, "multiple" means two or more unless explicitly specified otherwise.

In the description of the present disclosure, it is to be noted that unless otherwise expressly specified and defined, the terms "mounted", "connected", and "connected" are to be construed broadly, for example, as either a fixed connection, or a detachable connection, or an integral connection, either a mechanical connection, or an electrical connection. The specific meaning of the above term in the present disclosure will be understood by those of ordinary skill in the art depending on the particular circumstances, either directly or indirectly via an intermediate medium, communication between the two elements, or interaction between the two elements. The specific meanings of these terms in the present disclosure will be understood by those of ordinary skill in the art as the case may be.

The present disclosure is further described below in detail in combination with the accompanying drawings and embodiments.

First Embodiment

As shown in FIG. 1 to FIG. 5, this embodiment provides a knife sharpener, including a hand shank 1 and a sharpening member 2. Mounting portions 11 are arranged at two ends of the hand shank 1. An outer diameter of each of the mounting portions 11 is greater than an outer diameter of the hand shank 1. The sharpening member 2 is connected to the mounting portions 11, so that the sharpening member 2 and the hand shank 1 rotate axially.

Figure 4:
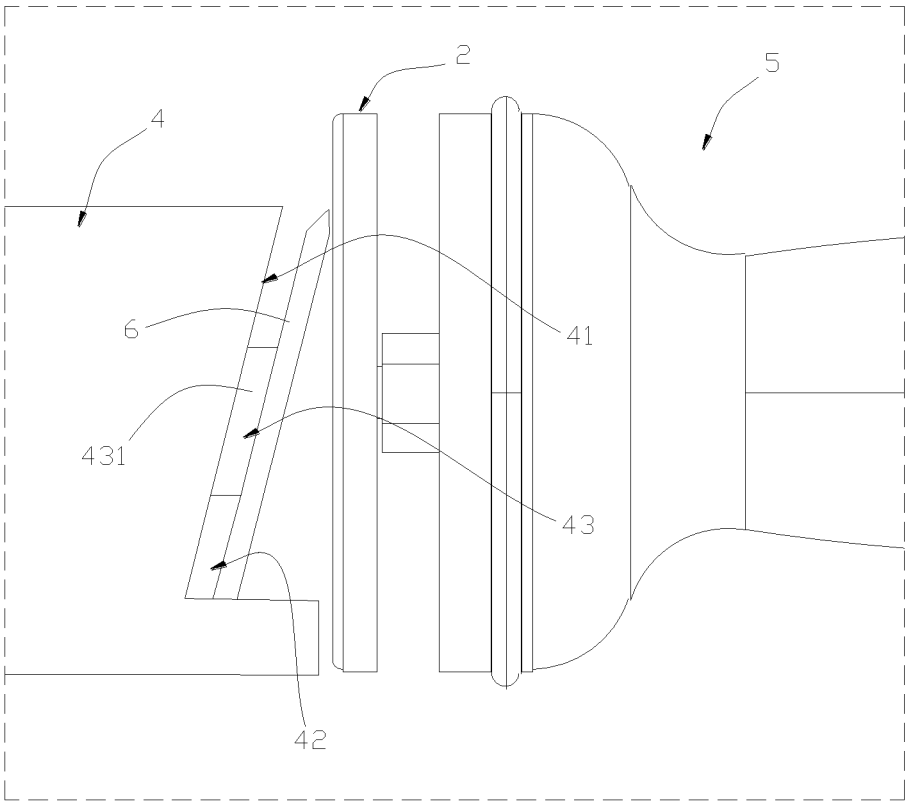
FIG. 4 is a diagram of a usage state of a knife sharpening device according to the present disclosure.
Figure 5:
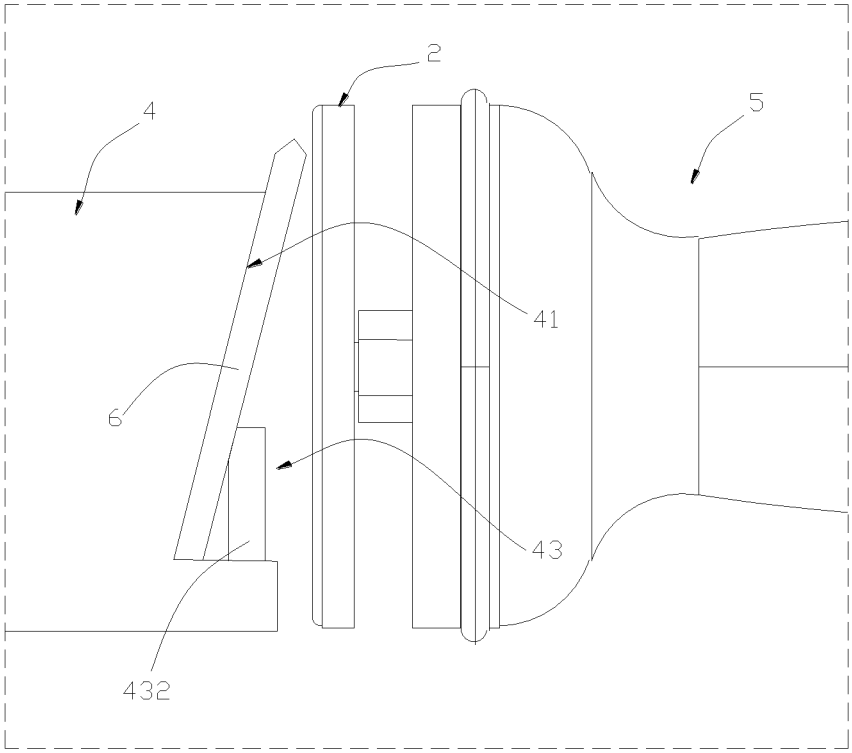
FIG. 5 is a diagram of another usage state of a knife sharpening device according to the present disclosure.

As shown in FIG. 4 to FIG. 5, it can be understood that the sharpening member 2 is configured to sharpen a knife 6. Specifically, during use, the knife sharpener is put on an operating platform, such as the ground or a tabletop, and the knife 6 is fixed on one side of the knife sharpener. The knife 6 can tilt towards an end portion of the knife sharpener to make a cutting edge lean against the sharpening member 2. During sharpening, a user pushes the hand shank 1 back and forth with the palm, so that the knife sharpener moves back and forth relative to the knife 6. In this process, the sharpening member 2 always presses against the cutting edge and does reciprocating motion relative to the cutting edge.

Further, in this embodiment, when the user pushes the hand shank 1 to rotate, the mounting portions 11 rotates coaxially with the hand shank 1, that is, angular velocities of the mounting portions 11 and an angular velocity of the hand shank 1 are always consistent. Based on the above principle, the present disclosure is creatively sets an outer diameter size of each mounting portion 11 to be much greater than an outer diameter size of the hand shank 1 because the small-sized hand shank 1 is convenient to hold and push by the user and the large-sized mounting portion 11 is in contact with the operating platform to drive the sharpening member 2 to roll on the operating platform. By the above structural arrangement, when the user pushes the hand shank 1 to rotate with the palm, the outer diameter size of each mounting portion 11 is set to be much greater than the outer diameter size of the hand shank 1, so that the mounting portion 11 can move for a longer distance than the hand shank 1 under the same rotation angle, which expands a motion range of the knife sharpener on the operating platform. A larger motion range ensures, under the same rotation angle, that the sharpening member 2 can sharpen the knife 6 for longer time, which improves the sharpening efficiency of the knife sharpener and saves time.

Further, due to the coaxial rotation between the sharpening member 2 and the mounting portions, the sharpening member 2 may rotate with the hand shank 1, instead of rotating relative to the hand shank 1, in the sharpening process of the knife 6, which increases a friction between the sharpening member 2 and the knife 6 in turn and improves the sharpening effect.

Further, the sharpening member 2 of this embodiment includes a first end portion 21 and a second end portion 22; and the first end portion 21 is provided with a sharpening portion configured to sharpen the knife 6. The sharpening portion may be of abrasive sand or some other rough structures. The second end portion 22 is connected to the mounting portion 11. Specifically, the mounting portion 11 includes a first connecting mechanism 31; the second end portion 22 includes a second connecting mechanism 32; the first connecting mechanism 31 is detachably connected to the second connecting mechanism 32 to detachably connect the sharpening member 2 to the mounting portion 11.

By the above structural arrangement, the sharpening member 2 can be detachably connected to the mounting portion 11 through the first connecting mechanism 31 and the second connecting mechanism 32, which is convenient for replacing the sharpening member 2. In addition, the hand shank 1 can also replace different sharpening members 2 according to different sharpening requirements, so as to adapt to different knives 6 and different application environments. The knife sharpener has a clever design and high practicability.

Figure 2:
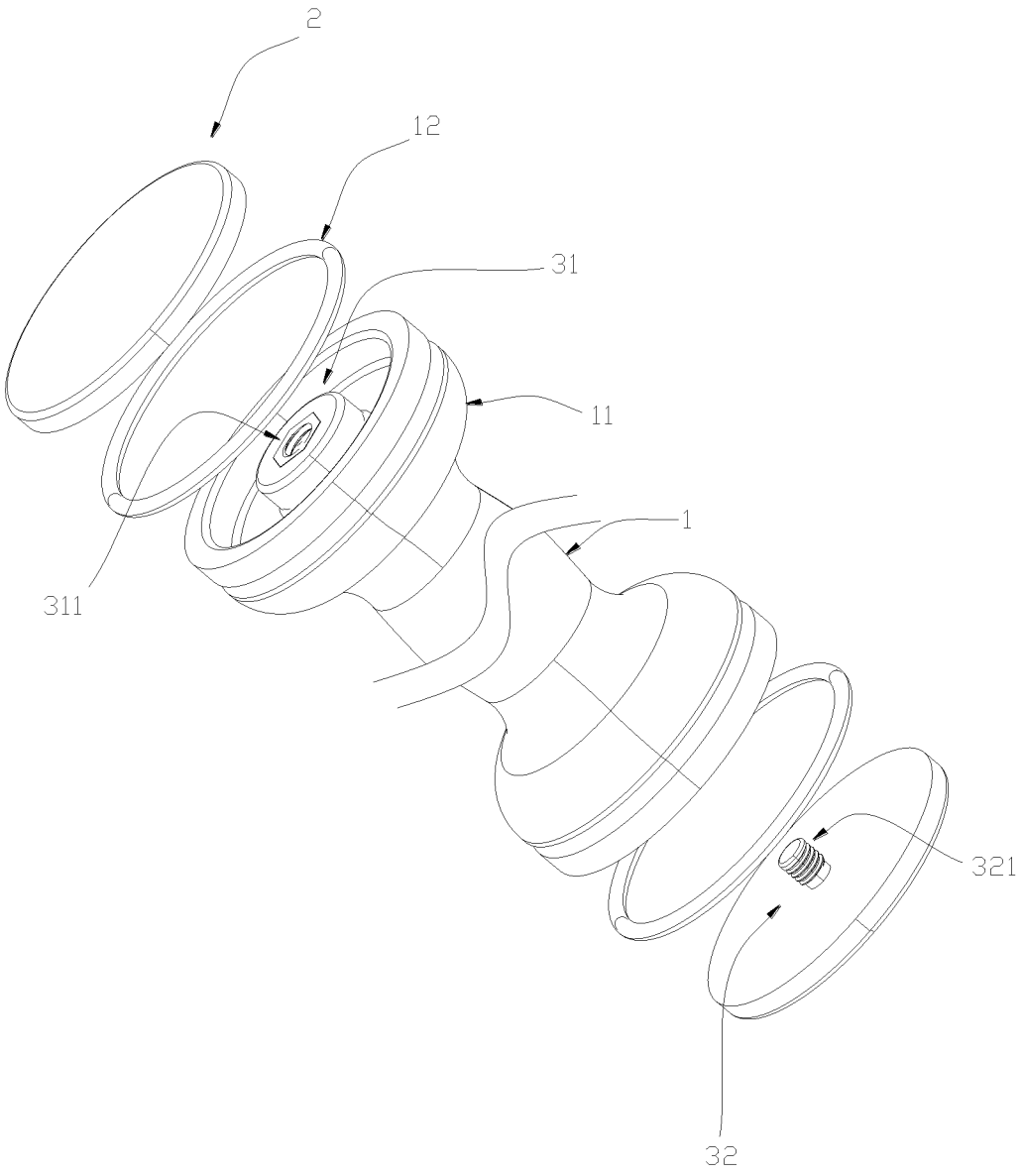
FIG. 2 is a schematic diagram of an exploded state of FIG. 1.

Further, as shown in FIG. 2, as one implementation of this embodiment, the first connecting mechanism 31 includes a mounting opening 311 arranged on an outer side of the mounting portion 11; the second connecting mechanism 32 includes a connecting portion 321 protruding from the second end portion 22; and each of the mounting opening 311 and the connecting portion 321 is provided with a threaded mechanism to achieve threaded connection between the connecting portion 321 and the mounting opening 311. In this embodiment, the mounting openings 311 and the connecting portions 321 can also be set to be magnetic suction structures to achieve the detachable connection.

Figure 3:
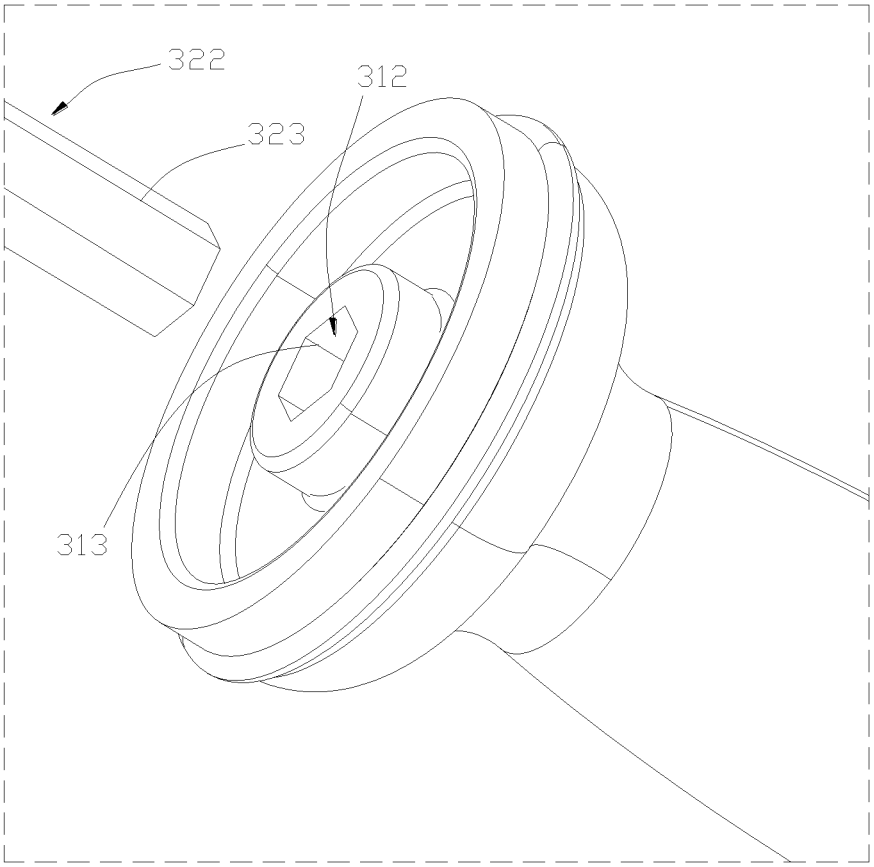
FIG. 3 is a schematic diagram of a connection relationship between a plugging portion and a plugging opening of a knife sharpener according to the present disclosure.

Further, as another implementation of this embodiment, as shown in FIG. 3, the first connecting mechanism 31 includes a plugging opening 312 arranged on an outer side of the mounting portion 11; the second connecting mechanism 32 includes a plugging portion 322 protruding from the second end portion 22; and the plugging portion 322 is in plugged connection to the plugging opening 312. Specifically, a first limiting portion 313 is arranged in the plugging opening 312; the plugging portion 322 is provided with a second limiting portion 323; and when the plugging portion 322 is in plugged connection to the plugging opening 312, the first limiting portion 313 resists against the second limiting portion 323 to prevent the sharpening member 2 from rotating relative to the hand shank 1.

It should be noted that the specific connection way for the first connecting mechanism 31 and the second connecting mechanism 32 is not limited to the above two ways, as long as the detachable fixed connection between the first connecting mechanism 31 and the second connecting mechanism 32 can be achieved, such as snap connection and interference assembling connection.

Further, the sharpening piece 2 of this embodiment includes a first sharpening unit 23 and a second sharpening unit 24; the first sharpening unit 23 is arranged on the mounting portion 11 at one end of the hand shank 1; and the second sharpening unit 24 is arranged on the mounting portion 11 at the other end of the hand shank 1. Specifically, the first sharpening unit 23 and the second sharpening unit 24 can be set as different sharpening components. For example, the first sharpening unit 23 can be configured to perform rough sharpening on the knife 6, and the second sharpening unit 24 can be configured to perform fine sharpening on the knife 6. The two sharpening units are used alternately, so as to improve the sharpening effect on the knife 6.

Further, in this embodiment, the knife sharpener further includes antiskid members 12, and the antiskid members 12 surround the mounting portions 11. Specifically, an annular clamping slot is formed around a side wall of each of the mounting portions 11. The antiskid members 12 are clamped into the annular clamping slots. By the above structural arrangement, when the knife sharpener rolls on a working platform through the mounting portions 11, the antiskid members 12 can contact the working platform to achieve an antiskid effect.

Second Embodiment

As shown in FIG. 1 to FIG. 5, this embodiment provides a knife sharpening device, including the knife sharpener in the first embodiment. Further, the knife sharpening device further includes a base 4. A supporting wall 41 for allowing a knife 6 to lean against is arranged on a side wall of the base 4; the supporting wall 41 and the ground form a supporting angle 42; and the supporting angle 42 is an acute angle.

It can be understood that to sharpen the knife 6, the knife 6 can lean against the supporting wall 41 while a cutting edge is upward. The knife sharpener is placed on one side of the knife 6, so that the sharpening member 2 resists against the cutting edge of the knife 6. In this case, the knife sharpener is pushed to cause the sharpening member 2 to frictionize the cutting edge, so as to sharpen the knife 6. The knife sharpening device has a simple structure and is convenient to operate.

Further, since the supporting wall 41 of this embodiment and the ground form the acute supporting angle 42, when the knife 6 leans against the supporting wall, an angle between the knife 6 and the ground is also acute. Due to the above structure, when the sharpening member 2 is in contact with the cutting edge of the knife 6, the sharpening member tilts, so that it is convenient to form the cutting edge during sharpening of the knife 6.

Further, as shown in FIG. 4, in order to improve the stability of the knife 6 on the supporting wall 41, as one implementation, a fixing mechanism 43 is further arranged on the supporting wall 41 and is configured to fix the knife 6 on the supporting wall 41. Specifically, the fixing mechanism 43 can be a suction member 431 configured to suck the knife 6 to the supporting wall 41. Specifically, the suction member 431 can be a magnet, viscose, or the like.

Further, as another implementation, as shown in FIG. 5, the fixing mechanism 43 can be a clamping mechanism, which is configured to fix the knife 6 on the supporting wall 41. Specifically, the clamping mechanism 432 can be a left clamping slot and a right clamping slot which are arranged on two sides of the supporting wall 41 in a protruding manner. The left clamping slot and the right clamping slot are respectively clamped to left and right sides of the knife 6, so as to fix the knife 6 on the supporting wall 41.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

The invention claimed is:

1. A knife sharpener, comprising a hand shank and two sharpening members, wherein two mounting portions are arranged at two ends of the hand shank respectively; an outer diameter of each of the mounting portions is greater than an outer diameter of the hand shank; and the two sharpening member are connected to the two mounting portions respectively, so that the sharpening members and the hand shank rotate axially; wherein the knife sharpener further comprises antiskid members surrounding the mounting portions.

2. The knife sharpener according to claim 1, wherein each sharpening member comprises a first end portion and a second end portion; the first end portion is provided with a sharpening portion configured to sharpen a knife; and the second end portion is connected to the mounting portion.

3. The knife sharpener according to claim 2, wherein each mounting portion comprises a first connecting mechanism; the second end portion comprises a second connecting mechanism; the first connecting mechanism is detachably connected to the second connecting mechanism to detachably connect each sharpening member to corresponding one of the two mounting portions.

4. The knife sharpener according to claim 3, wherein the first connecting mechanism comprises a mounting opening arranged on an outer side of the mounting portion; the second connecting mechanism comprises a connecting portion protruding from the second end portion; and each of the mounting opening and the connecting portion is provided with a threaded mechanism to achieve threaded connection between the connecting portion and the mounting opening.

5. The knife sharpener according to claim 3, wherein the first connecting mechanism comprises a plugging opening arranged on an outer side of the mounting portion; the second connecting mechanism comprises a plugging portion protruding from the second end portion; and the plugging portion is in plugged connection to the plugging opening.

6. The knife sharpener according to claim 5, wherein a first limiting portion is arranged in the plugging opening; the plugging portion is provided with a second limiting portion; and when the plugging portion is in plugged connection to the plugging opening, the first limiting portion resists against the second limiting portion to prevent each sharpening member from rotating relative to the hand shank.

7. The knife sharpener according to claim 1, wherein the sharpening piece comprises a first sharpening unit and a second sharpening unit; the first sharpening unit is arranged on the mounting portion at one end of the hand shank; and the second sharpening unit is arranged on the mounting portion at the other end of the hand shank.

8. A knife sharpening device, comprising a base and a knife sharpener, wherein two mounting portions are arranged at two ends of a hand shank respectively; an outer diameter of each of two mounting portions is greater than an outer diameter of the hand shank; and two sharpening members are connected to the two mounting portions respectively, so that the sharpening members and the hand shank rotate axially, a supporting wall for allowing a knife to lean against is arranged on a side wall of the base; the supporting wall and the ground form a supporting angle; and the supporting angle is an acute angle; wherein the knife sharpener further comprises antiskid members surrounding the mounting portions.

9. The knife sharpening device according to claim 8, wherein a fixing mechanism is arranged on the supporting wall and is configured to fix the knife on the supporting wall.

10. The knife sharpener device according to claim 8, wherein the two sharpening members comprise a first end portion and a second end portion; the first end portion is provided with a sharpening portion configured to sharpen a knife; and the second end portion is connected to the mounting portion.

11. The knife sharpener device according to claim 10, wherein each mounting portion comprises a first connecting mechanism; the second end portion comprises a second connecting mechanism; the first connecting mechanism is detachably connected to the second connecting mechanism to detachably connect each sharpening member to corresponding one of the two mounting portions.

12. The knife sharpener device according to claim 11, wherein the first connecting mechanism comprises a mounting opening arranged on an outer side of the mounting portion; the second connecting mechanism comprises a connecting portion protruding from the second end portion; and each of the mounting opening and the connecting portion is provided with a threaded mechanism to achieve threaded connection between the connecting portion and the mounting opening.

13. The knife sharpener device according to claim 11, wherein the first connecting mechanism comprises a plugging opening arranged on an outer side of the mounting portion; the second connecting mechanism comprises a plugging portion protruding from the second end portion; and the plugging portion is in plugged connection to the plugging opening.

14. The knife sharpener device according to claim 13, wherein a first limiting portion is arranged in the plugging opening; the plugging portion is provided with a second limiting portion; and when the plugging portion is in plugged connection to the plugging opening, the first limiting portion resists against the second limiting portion to prevent each sharpening member from rotating relative to the hand shank.

15. The knife sharpener device according to claim 8, wherein the sharpening piece comprises a first sharpening unit and a second sharpening unit; the first sharpening unit is arranged on the mounting portion at one end of the hand shank; and the second sharpening unit is arranged on the mounting portion at the other end of the hand shank.

* * * * *